US007832109B2

(12) United States Patent
Gibbs

(10) Patent No.: US 7,832,109 B2
(45) Date of Patent: Nov. 16, 2010

(54) ARCHERY BOW SIGHT AND METHOD

(75) Inventor: Charles S. Gibbs, Holton, IN (US); Dianne C. Gibbs, legal representative, Holton, IN (US)

(73) Assignee: Field Logic, Inc., Superior, WI (US)

( * ) Notice: Subject to any disclaimer, the term of this patent is extended or adjusted under 35 U.S.C. 154(b) by 131 days.

(21) Appl. No.: 12/182,730

(22) Filed: Jul. 30, 2008

(65) Prior Publication Data

US 2010/0024228 A1 Feb. 4, 2010

(51) Int. Cl.
*F41G 1/467* (2006.01)

(52) U.S. Cl. ..... 33/265; 124/87

(58) Field of Classification Search ..... 33/265; 124/87

See application file for complete search history.

(56) References Cited

U.S. PATENT DOCUMENTS

| | | | | |
|---|---|---|---|---|
| 2,332,080 | A | 10/1943 | Howe | |
| 2,991,556 | A | 7/1961 | Wilchek | |
| 3,163,937 | A | 1/1965 | Reynolds | |
| 3,475,820 | A | 11/1969 | Kernan | |
| 3,822,479 | A | 7/1974 | Kowalski | |
| 4,535,747 | A | 8/1985 | Kudlacek | |
| 4,625,421 | A | 12/1986 | Strauss | |
| 5,384,966 | A | 1/1995 | Gibbs | |
| 5,509,401 | A | 4/1996 | Trubic | |
| 5,560,113 | A * | 10/1996 | Simo et al. | 33/265 |
| 5,676,122 | A | 10/1997 | Wiseby et al. | |
| RE36,266 | E | 8/1999 | Gibbs | |
| 6,073,352 | A * | 6/2000 | Zykan et al. | 33/265 |
| 6,418,633 | B1 * | 7/2002 | Rager | 33/265 |
| 6,732,727 | B1 | 5/2004 | Gallops, Jr. | |
| 6,892,462 | B2 * | 5/2005 | Rager | 33/265 |
| 7,000,327 | B2 | 2/2006 | Rager | |
| 7,103,981 | B1 * | 9/2006 | Rager | 33/265 |
| RE39,686 | E * | 6/2007 | Khoshnood | 33/265 |
| 7,275,329 | B2 * | 10/2007 | Rager | 33/265 |
| 7,331,112 | B2 | 2/2008 | Gibbs | |
| 7,549,230 | B2 * | 6/2009 | Rager | 33/265 |
| 7,578,067 | B2 * | 8/2009 | Rager | 33/265 |
| 2004/0031162 | A1 * | 2/2004 | Rager | 33/265 |
| 2006/0156561 | A1 * | 7/2006 | Afshari | 33/265 |
| 2007/0220761 | A1 | 9/2007 | Helm et al. | |
| 2008/0235962 | A1 * | 10/2008 | Sims et al. | 33/265 |
| 2010/0024228 | A1 * | 2/2010 | Gibbs et al. | 33/265 |

* cited by examiner

*Primary Examiner*—Yaritza Guadalupe-McCall
(74) *Attorney, Agent, or Firm*—Stoel Rives LLP

(57) ABSTRACT

A sight assembly is adapted for connection to a bow. The sight assembly includes a base sight having a sight opening and forming a pocket along an edge thereof. A pin cartridge is releasably connected to the base sight and is located within the pocket. When installed, the cartridge is adapted for supporting at least one pin at least partially within the sight opening.

14 Claims, 4 Drawing Sheets

ARCHERY BOW SIGHT AND METHOD

FIELD OF THE INVENTION

This disclosure generally relates to sights for use with archery bows and, more particularly, to sights that are adjustable and removable from the bow.

BACKGROUND

Archery is the practice of using a bow to shoot arrows. Archers use many types of bows for the sport, which is often a test of skill and precision whether the archer is contending with a still target or hunting prey. There are many different types of bows known, with each type being used for a different purpose. Known bow types are classified according to the shape of the bow, for example, long bows, flat bows, or short bows. Recurve bows have limbs that curve forward and are used typically for sport, while compound bows are designed to reduce the force that an archer must hold by typically using cams or elliptical wheels on the ends of the limbs to optimize the leverage exerted by the archer. A variation on the general bow design is a crossbow, whose limbs are held horizontally instead of vertically.

Regardless of the type of bow used, the desire for precision and accuracy when shooting an arrow has given rise to various aiming devices or sights. Some aiming devices use a barrel shaped tube which is connected to the bow and serves to provide the archer with a visual path, in a straight line, representing the path of the arrow. Sights that are more sophisticated include devices which visually represent reference points for the archer. One example of a known archery sight can be found in U.S. Pat. No. 7,331,112, which issued on Feb. 19, 2008, and which is incorporated herein in its entirety by reference. The patent discloses a third-axis leveling block for a bow sight. This sight is configured to hold an archery sighting device, for example, a scope or a pin sight, and is very effective at adjusting the position of the sight.

Even though the example described above and other known examples of sights are effective at aiding the archer while targeting, they are not suited for use in more than one shooting position, after having been adjusted by the archer, without re-adjustment. In other words, the sighting devices and sights known presently in the art may be adjusted for a given set of shooting circumstances, for example, distance, wind, elevation, and so forth, thus requiring a resetting when the conditions change. This changing of the settings before shots tends to reduce the overall precision and accuracy of the archer when moving from a first set of conditions, to a different set of conditions.

BRIEF SUMMARY OF THE DISCLOSURE

This disclosure provides, in one aspect, a sight assembly for an archery bow. The sight assembly is adapted for connection to the bow. The sight assembly includes a base sight having a sight opening and forming a pocket along an edge thereof. A pin cartridge is connected to the base sight and is located within the pocket. When installed, the cartridge is adapted for supporting at least one pin at least partially within the sight opening.

In another aspect, this disclosure provides a sight for an archery bow. The sight includes a support structure adapted for connection to the bow, a windage block adjustably connected to a distal end of the support structure, and a sight mounting block connected to the windage block. A sight base is connected to the sight mounting block and forms two base portions surrounding a pocket. The sight base further forms a guard portion defining an opening, which is positioned adjacent to the pocket. A cartridge is releasably connected to the sight base and located within the pocket. At least one sighting pin is mounted in the cartridge such that a tip of the at least one pin is disposed within the opening defined in the guard portion.

In yet another aspect, this disclosure provides a sight for an archery bow. The sight includes a mount that is releasably connectable to a portion of the archery bow. An elongate portion defined in the mount connects to a sighting assembly. The sighting assembly includes a windage block slideably connected adjacent a distal end of the elongate portion, a sighting support block connected to the windage block, and a sighting base portion connected to the sighting support block. A pocket formed in the sighting base portion accommodates the cartridge. At least one slot formed in the cartridge adjustably supports at least one sighting pin. The cartridge defines a base portion and a body portion, such that the body portion forms the at least one slot. The sighting base portion further defines a guard that surrounds an opening such that a tip of the at least one pin disposed in the cartridge is located within the opening of the guard when the cartridge is connected to the sighting base portion.

DETAILED DESCRIPTION

The present disclosure provides a modular sighting device for use with archery bows. The modular sighting device includes a body portion which is rigidly attached to a sight, and one or more sight cartridges. Each sight cartridge is insertable into the body of the sight and may be fully adjusted by the archer to suit any given set of shooting conditions, for example, shot distance, elevation, wind, and so forth. Because of the modular nature of the sight, each cartridge may be set to a specific set of circumstances and retain its setting without the need of readjustment when the archer returns to take the same shot. The cartridges are replaceable within the sight such that any given cartridge may be set to a specific set of circumstances, and remain set in that manner even while the archer is setting up to take a different shot. The archer can simply replace the cartridge with a new one, thus retaining the original settings on the cartridge removed until they are required again.

Figure 1:
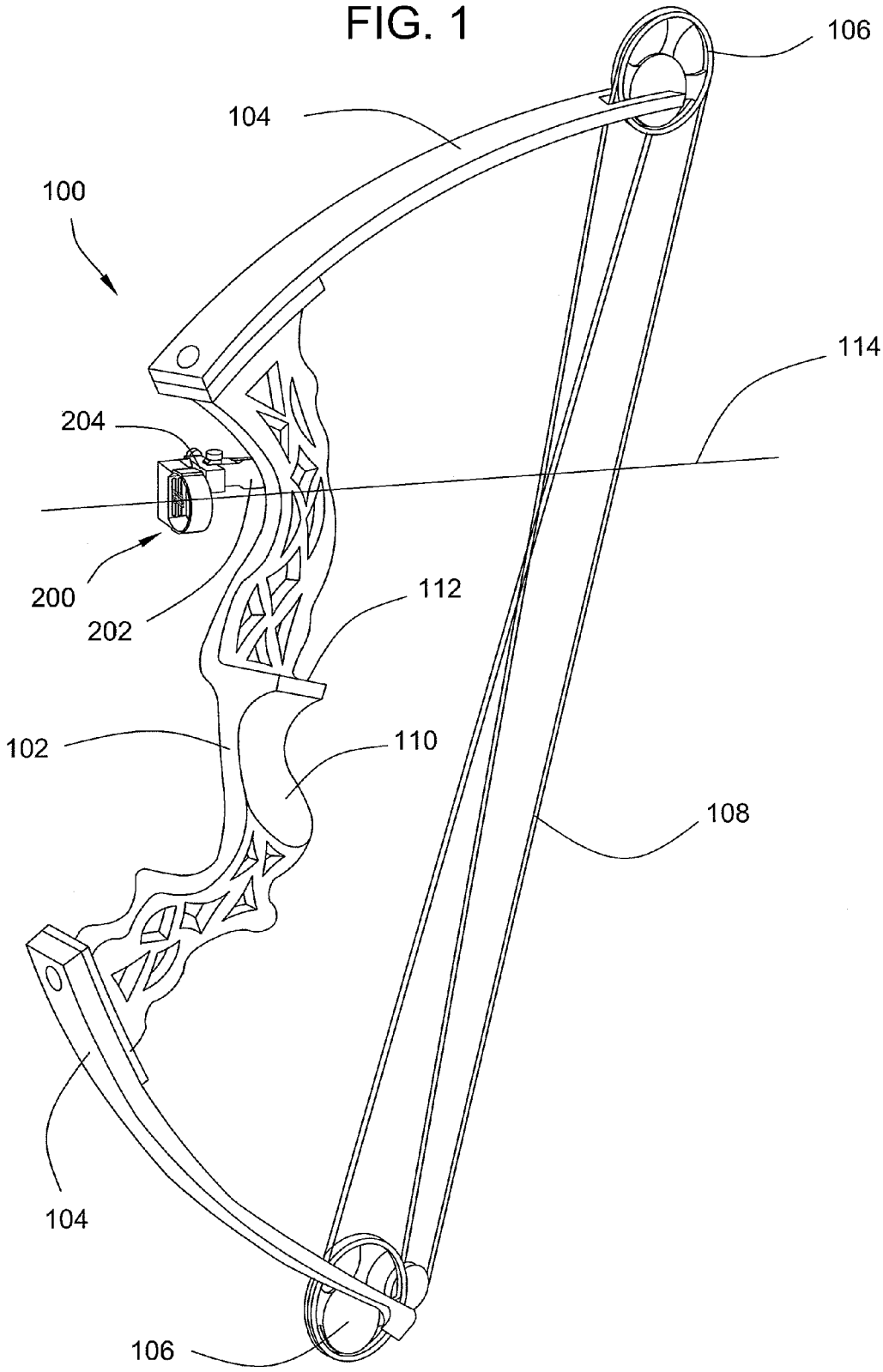
FIG. 1 is an outline of a compound bow having a sight assembly connected thereto in accordance with the disclosure.

To illustrate a manner of use of a sight in accordance with this disclosure, an outline view of a bow 100 having a sight 200 associated therewith is shown in FIG. 1. Further details concerning one example of a mounting arrangement between a sight and a bow can be seen in U.S. Pat. No. 7,331,112. Returning now to FIG. 1, the bow 100 includes a middle portion 102 connected to two arms 104 that are disposed on either side of the middle portion 102. Two pulleys 106 are connected, one each, on the two distal ends of the arms 104. A string 108 wraps around the pulleys 106 and extends across the opening between the arms 104. The compound bow 100 is presented for illustration and should not be construed as limiting of the type of bow that can benefit from the sights described and claimed in this disclosure.

The middle portion 102 of the bow 100 forms a grip 110 and a shelf 112 that is located adjacent to the grip 110. When an archer is using the bow 100, one arm of the archer holds the grip 110 while the other holds an arrow over the shelf 112. When taking a shot, the archer retracts the arrow (not shown) against the string 108, thus extending the string and bending or canting the arms 104. The mechanical energy stored in the bow 100 in this condition propels the arrow.

To assist the archer in aiming the arrow, the sight 200 is located along a line of sight 114 of the archer. The line of sight 114, which is denoted here as a straight line, is an imaginary line connecting the eye of the archer to the target through the sight 200. The sight 200, which is explained in further detail below, generally includes a support structure 202 and a sight structure 204. The support structure 202 discussed herein is one example of many possible support structures that may be used; further examples of support structures can be seen in U.S. Pat. No. 7,331,112 discussed above and in Reissued U.S. Pat. RE36266, which issued on Aug. 17, 1999, and is incorporated here in its entirety by reference.

Figure 2:
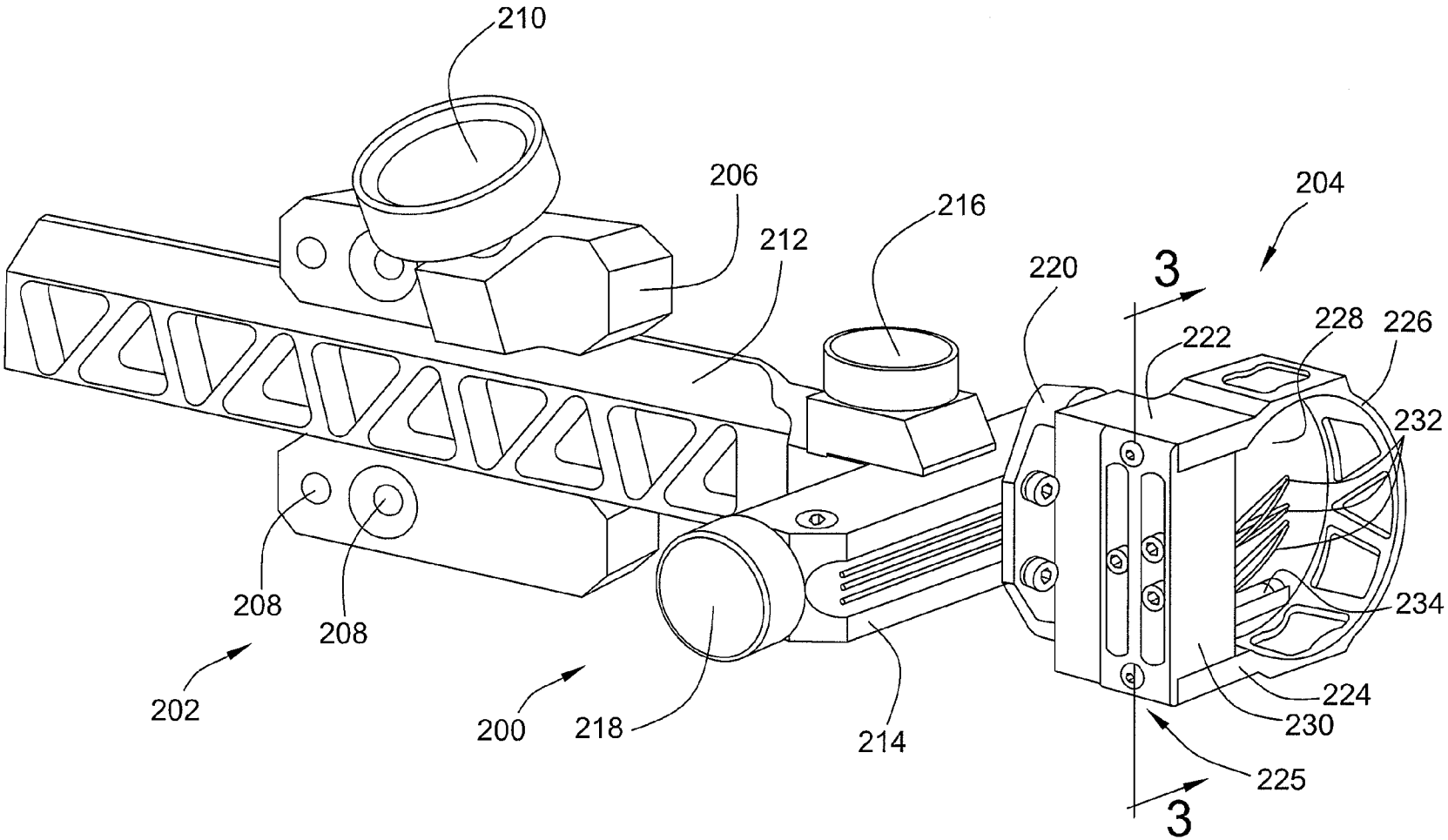
FIG. 2 is an outline of one embodiment of a sight assembly in accordance with the disclosure.

FIG. 2 presents an outline view of the sight 200, which is shown detached from the bow 100 for the sake of clarity. The support structure 202 includes an attachment mechanism or block 206 which connects the sight 200 to the bow 100. In this embodiment, the attachment block 206 forms a series of openings 208 that accommodate fasteners connecting the attachment block 206 to the middle portion 102 of the bow 100 (FIG. 1.) An adjustment knob 210 adjustably and slidably connects the attachment block 206 to an elongate support 212. The elongate support 212 extends axially away from the bow 100 in a direction along the path of an arrow shot by the bow 100. On a distal end thereof, the elongate support 212 slideably connects to a windage block 214. The windage block 214 can move perpendicularly to a major axis of the elongate support 212. A threaded knob 216 connects the windage block 214 to the elongate support 212.

Movement of the windage block 214 is accomplished by a threaded rod connected to an adjustment knob 218, the rotation of which causes the windage block 214 to move relative to the elongate support 212. When the sight 200 is connected to the bow 100, or another equivalent bow, rotation of the knob 218 moves the windage block 214 in a generally horizontal manner so that the archer is able to compensate for prevailing winds moving across the arrow's path when taking a shot.

The windage block 214 connects to a sight support block 220. The sight support block 220 connects a body portion 222 of the sight 204 to the windage block 214. The body portion 222 of the sight 204 forms a base portion 224 connected to a circular guard 226. The base portion 224 forms a pocket 225 between two projections that are formed along an edge thereof. The guard 226 surrounds an opening 228 that lies along the line of sight 114 (FIG. 1) when the sight 200 is connected to the bow 100.

A pin cartridge 230 is connected the body portion 222 of the sight 204. The pin cartridge 230 as shown presents three pins 232 within the opening 228. The pins 232 are used when aiming the arrow, as is known in the art. As is further known in the art, a level 234 may also be located within the opening 228 to aid the archer in appropriately orienting the bow with respect to the horizon. A partial cross section taken along line 3-3 in FIG. 2 of the pin cartridge 230 is presented in FIG. 3. In this view, all but one of the pins 232 have been removed for the sake of clarity. In the description that follows, like reference numerals are used to denote like elements for the sake of clarity.

Figure 3:
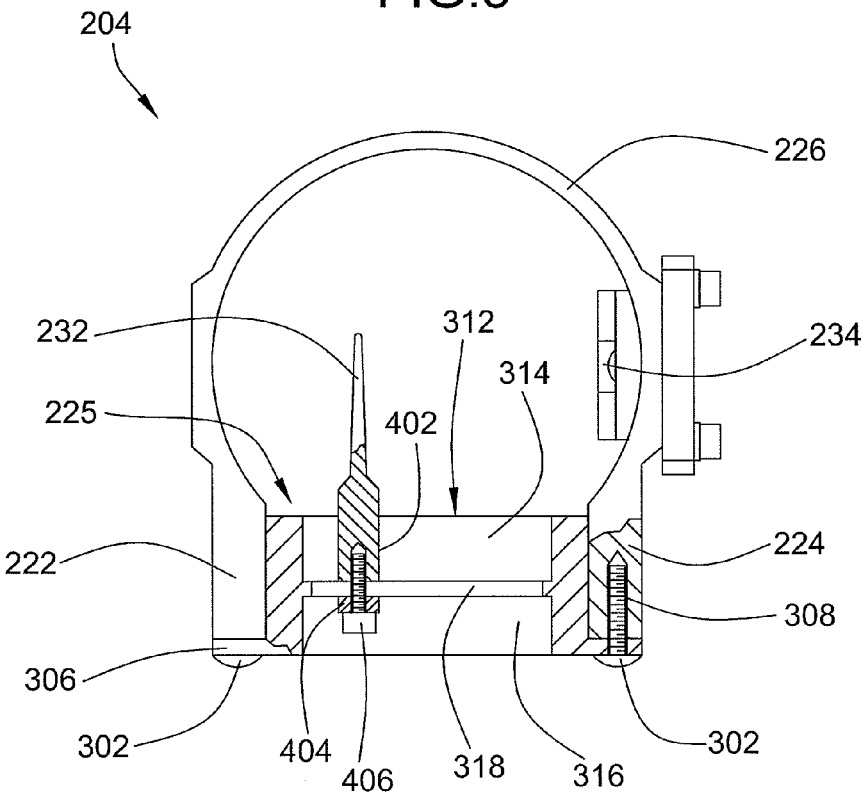
FIG. 3 is a partial cross section of a sight having a pin cartridge installed in a pocket thereof in accordance with the disclosure.
Figure 4:
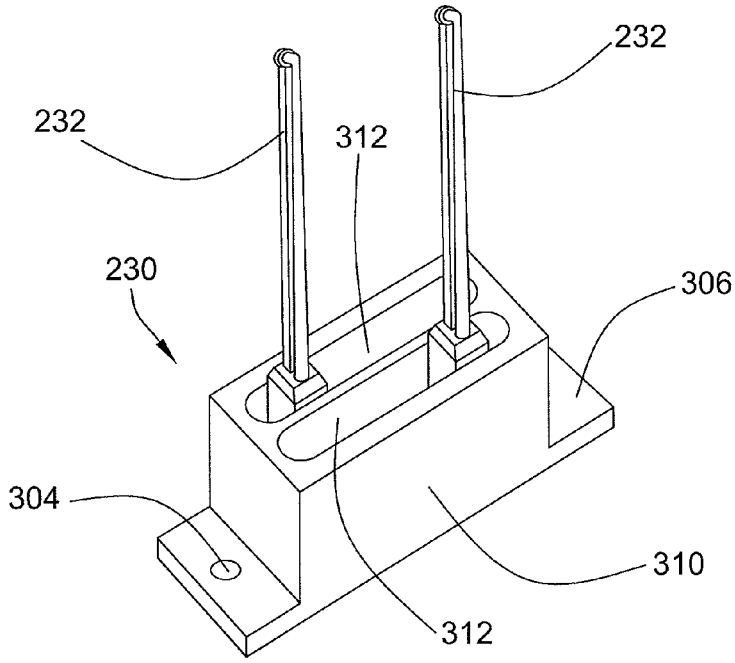
FIG. 4 is an outline of a pin cartridge having two pins installed therein in accordance with the disclosure.

As can be seen in FIG. 3, and in conjunction with FIG. 4, the cartridge 230 is connected to the body portion 222 of the sight 204 by two fasteners 302. The cartridge 230 is positioned within the pocket 225. The fasteners 302 pass through openings 304 that are formed in a flange portion 306 of the cartridge 230. The fasteners 302 threadably engage a respective one of two threaded openings 308 formed in the base portion 224. The flange portion 306 of the cartridge 230 surrounds a main body 310 thereof. The main body 310 is generally shaped as a right-hexahedron, and supports the pins 232 in an adjustable fashion within two slots 312 formed through the main body 310.

As the cross-section of FIG. 3 shows more clearly, each slot 312 forms a first portion 314 and a second portion 316 that are separated by a ledge 318. The ledge 318 extends peripherally along an inner portion of each slot 312. The ledge 318 is used to secure the pins 232 to the cartridge 230. The arrangement shown and described herein is one possible arrangement for adjustably connecting the pins 232 to the cartridge 230, but other arrangements may be used.

In the arrangement as shown in FIG. 3, each pin 232 includes a pointer or tip 402 connected to a retainer 404 along either side of the ledge 318. The tip 402 has an elongate shape and is connected to the retainer 404 with a fastener 406. When the fastener 406 is tightened, the retainer 404 cooperates with the tip 402 to attach the pin 232 onto a portion of the ledge 318 and secure the pin 232 in a desired position within the slot 312. The archer can adjust the position of the pin 232 within the slot 312 by loosening, moving, and then tightening the fastener 406.

In a typical sight arrangement, the slots may be formed in a unitary structure which includes the base sight. In other words, a typical sight does not have a removable cartridge 230. As a result, the position of pins 232 in a typical sight requires readjustment when shooting conditions change. In the embodiments described herein, the archer may advantageously adjust the position of the pins 232 within the cartridge 230, and when faced with changed conditions or shooting positions, the archer may remove the cartridge 230 from the sight 204 by removing the fasteners 302 and pulling the cartridge out, to replace it with a different cartridge having additional pins 232 associated therewith that can be or have been adjusted to the different conditions. When the archer returns to shooting in the first set of circumstances, the archer may advantageously replace the first cartridge 230 that was previously removed without loss of shot accuracy or the need for readjustment.

In one embodiment in accordance with this disclosure, the cartridge 230 is shown to have two slots 312, with each slot 312 capable of accommodating one or more pins 232. As can be appreciated, the cartridge 230 or a similar cartridge may have fewer or more than two slots formed therein, each of which can accommodate fewer or more than the three pins 232 shown in FIG. 2. Because the pins 232, or more specifically, the tips of the pins 232, are used by the archer when sighting a target, it is important for the tips of the pins 232 to lie along the same imaginary line. In other words, having two or more slots formed in the cartridge 230 may require an adjustment to the distance of each of the pins 232 within each slot 312 from the eye of the archer. One possible arrangement for accomplishing this adjustment can be seen in the cross-sections of FIG. 5 and FIG. 6.

Figure 5:
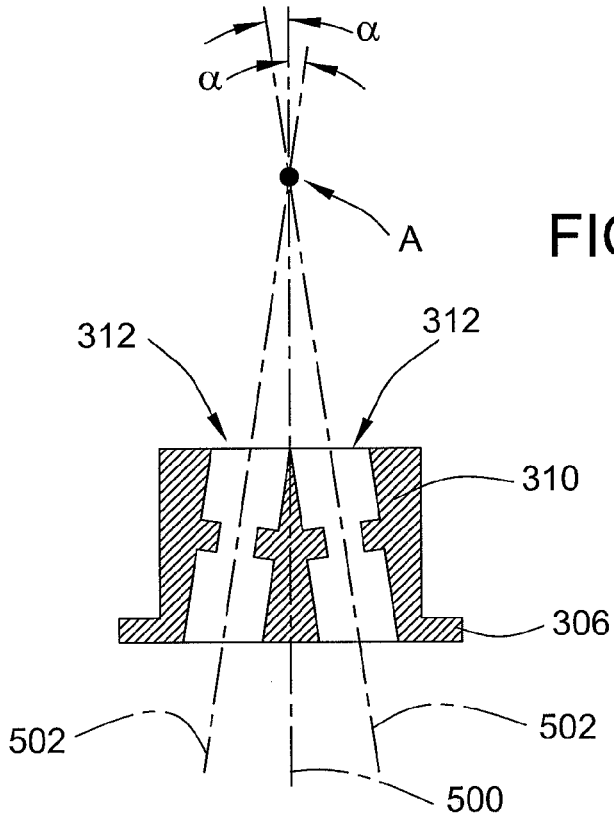
FIG. 5 and FIG. 6 are cross sections of a pin cartridge in accordance with the disclosure.
Figure 6:
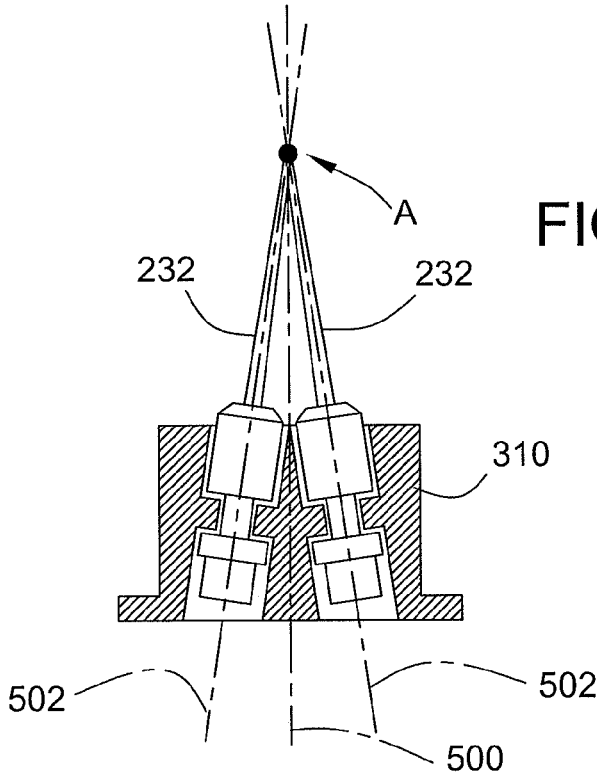

When the cartridge 230 is installed in the sight 200, an imaginary line, A, which appears in FIGS. 5 and 6 as a point, extends vertically with respect to the ground such that the tips of each of the pins 232 that are assembled into the cartridge 230 are substantially aligned. Alignment of the tips of the pins 232 and, of course, the ability to adjust the position of each pin 232, enables the archer to have visual reference points with respect to height when taking a shot. For example, if a cartridge formed slots extending parallel to each other (not shown), pins inserted into each of the slots could be manufactured with bent portions (not shown) such that their tips would be aligned along line A. In the embodiment presented in FIGS. 5 and 6, the same type of pin 232 is advantageously used in each of the slots 312. The tips of the pins 232 are aligned by forming the slots 312 at an angle to each other.

Each of the two slots 312 is formed at an angle, a, with respect to a centerline 500 of the cartridge 230, which can be considered to define a central plane of symmetry across the body portion 310. An imaginary centerline or axis of symmetry for each of the slots 312, with both axes denoted generally as 502 and each defining first and second planes of symmetry for their respective slots 312, intersects the centerline 500 at the angle $\alpha$. In this embodiment, the angle $\alpha$ is about ten degrees, but other angles may be used. When pins 232 are installed into each of the slots 312, as shown in FIG. 6, the sum of both angles $\alpha$ forms an included angle of about twenty degrees. This included angle may be appropriately selected depending on the width of the cartridge and the distance between the slots 312 such that the tips of the pins 232 are disposed close to the imaginary line A.

In an alternate embodiment, a cartridge having three slots may be arranged such that two of the three slots are disposed on either side of a central slot. The central slot might be formed along the centerline of the cartridge while each of the other two outer slots can be arranged along two sides of an included angle around the center line such that pins disposed in each of the three slots may have their pins aligned along the imaginary line A. The embodiments described thus far and other embodiments discussed are described relative to the embodiments and structures presented. Any sight arrangement having a removable cartridge incorporated therewith is contemplated.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

We claim:

1. A sight assembly for an archery bow, the sight assembly adapted for connection to a sight support arrangement that is connectable to the archery bow, the sight assembly comprising:

a base sight connected to the sight support arrangement, the base sight having a sight opening and forming a pocket along an edge thereof;

a pin cartridge releasably connected to the base sight, the pin cartridge disposed within the pocket;

a slot formed in the pin cartridge and extending through the pin cartridge, wherein the slot is adapted to adjustably engage at least one pin;

an additional slot formed in the pin cartridge and extending through the pin cartridge, the additional slot disposed adjacent the slot;

wherein the pin cartridge is adapted for supporting the at least one pin at least partially within the sight opening, and wherein the slot is symmetrical about a first plane of symmetry, wherein the additional slot is symmetrical about a second plane of symmetry, wherein the pin cartridge forms a body portion that is symmetrical about a central plane of symmetry, and wherein each of the first plane of symmetry and the second plane of symmetry intersects the central plane of symmetry along a line.

2. The sight assembly of claim 1, further including a guard portion formed on the base sight, the guard portion surrounding the sight opening.

3. The sight assembly of claim 1, further including:

a flange portion defined in the pin cartridge; and a body portion defined in the pin cartridge;

wherein the body portion fits within the pocket of the base sight, and wherein the flange portion is in contact with the base sight operably attaching the pin cartridge to the base sight.

4. The sight assembly of claim 3, wherein the base sight further includes two threaded openings formed around the pocket, wherein the flange portion forms two through openings that align, one each, with each of the two threaded openings, and wherein the sight assembly further includes two fasteners, each fastener threadably engaging a respective one of the two threaded openings, and wherein each fasteners is disposed within a respective one of the two through openings thus securing the pin cartridge to the base sight.

5. The sight assembly of claim 1, wherein the slot defines a first portion and a second portion along a length thereof, and wherein the sight assembly further includes a ledge formed in the pin cartridge, the ledge disposed within the slot and extending peripherally along an inner portion of the slot.

6. The sight assembly of claim 1, wherein the first plane of symmetry intersects the central plane of symmetry at a first angle, and wherein the second plane of symmetry intersects the central plane of symmetry at a second angle.

7. The sight assembly of claim 6, wherein the first angle is substantially equal to the second angle.

8. A sight for an archery bow, comprising:

a support structure adapted for connection to a bow;

a windage block adjustably disposed on a distal end of the support structure opposite the bow;

a sight mounting block connected to the windage block;

a sight base connected to the sight mounting block, the sight base forming two base portions surrounding a pocket and a guard portion defining an opening, the opening disposed adjacent to the pocket;

a cartridge releasably connected to the sight base, the cartridge disposed within the pocket;

at least one pin operably associated with the cartridge;

a slot formed in the cartridge and extending through the cartridge, wherein the slot is adapted to adjustably engage the at least one pin and is symmetrical about a first plane of symmetry;

an additional slot formed in the cartridge and extending through the cartridge, the additional slot disposed adjacent the slot and being symmetrical about a second plane of symmetry;

wherein when the cartridge is connected to the sight base, a tip of the at least one pin is disposed within the opening defined in the guard portion; and wherein the cartridge defines a body portion that is symmetrical about a central plane of symmetry, wherein each of the first plane of symmetry and the second plane of symmetry intersects the central plane of symmetry along a line, wherein the first plane of symmetry intersects the central plane of symmetry at a first angle, and wherein the second plane of symmetry intersects the central plane of symmetry at a second angle.

9. The sight of claim 8, further including:

a flange portion defined in the cartridge; and a body portion defined in the cartridge;

wherein the body portion fits within the pocket of the sight base, and wherein the flange portion is in contact with the sight base operably attaching the cartridge to the sight base.

10. The sight of claim 9, wherein the body portion is generally shaped as a right hexahedron.

11. The sight of claim 9, wherein the sight base further includes two threaded openings formed around the pocket, wherein the flange portion forms two through openings that align, one each, with each of the two threaded openings, and wherein the sight further includes two fasteners, each fastener threadably engaging a respective one of the two threaded openings, and wherein each fasteners is disposed within a respective one of the two through openings thus securing the cartridge to the sight base.

12. The sight of claim 8, wherein the slot defines a first portion and a second portion along a length thereof, and wherein the sight further includes a ledge formed in the cartridge, the ledge disposed within the slot and extending peripherally along an inner portion of the slot.

13. The sight of claim 8, wherein the first angle is substantially equal to the second angle.

14. A sight for an archery bow, comprising:

a mount adapted for being releasably connected to a portion of the archery bow, the mount being removable from the archery bow but otherwise rigidly attached thereto when connected to the archery bow;

an elongate portion defined in the mount, the elongate portion connecting a sighting assembly to the mount, the sighting assembly including:

a windage block slideably connected adjacent a distal end of the elongate portion;

a sighting support block connected to the windage block; and a sighting base portion connected to the sighting support block;

a pocket formed in the sighting base portion;

a cartridge releasably disposed within the pocket;

at least one slot formed in the cartridge, the at least one slot adapted to adjustably support at least one pin;

wherein the cartridge defines a base portion and a body portion, the body portion forming the at least one slot and disposed within the pocket; and wherein the sighting base portion defines a guard, the guard surrounding an opening, wherein a tip of the at least one pin is disposed in the cartridge is located within the opening of the guard when the cartridge is connected to the sighting base portion.

* * * * *